United States Patent [19]

Carmen

[11] 4,103,361

[45] Aug. 1, 1978

[54] OUTERWEAR

[75] Inventor: Hyman Carmen, St. Laurent, Canada

[73] Assignee: Evin Industries Ltd., Montreal, Canada

[21] Appl. No.: 810,395

[22] Filed: Jun. 27, 1977

[30] Foreign Application Priority Data

Jun. 7, 1977 [CA] Canada ..... 280067

[51] Int. Cl.[2] ..... A41D 1/00

[52] U.S. Cl. ..... 2/97

[58] Field of Search ..... 2/97, 93, 108

[56] References Cited

U.S. PATENT DOCUMENTS

| | | | |
|---|---|---|---|
| 2,073,231 | 3/1937 | Siegel | 2/97 |
| 2,441,122 | 5/1948 | Sturz | 2/97 |
| 2,514,515 | 7/1950 | Roe | 2/97 |
| 2,581,206 | 1/1952 | Rosenfeld | 2/97 |
| 2,582,772 | 1/1952 | Egbert | 2/97 X |
| 2,711,539 | 6/1955 | Loscher | 2/97 X |
| 3,805,296 | 4/1974 | Frick | 2/97 X |

*Primary Examiner*—Alfred R. Guest

*Attorney, Agent, or Firm*—Swabey, Mitchell, Houle, Marcoux & Sher

[57] ABSTRACT

An outerwear coat or jacket is provided with a removable liner whereby the liner has fastener means spaced from the edges of the liner adapted to engage mating fastener means on the edges of the outer shell so as to leave marginal panels projecting from the front edge of the outer shell to effectively increase the overall girth of the outerwear when the liner is fitted to the outer shell such that the internal girth is the same when the outer shell is worn with the liner as when the outer shell is worn independently.

6 Claims, 7 Drawing Figures

Fig. 3
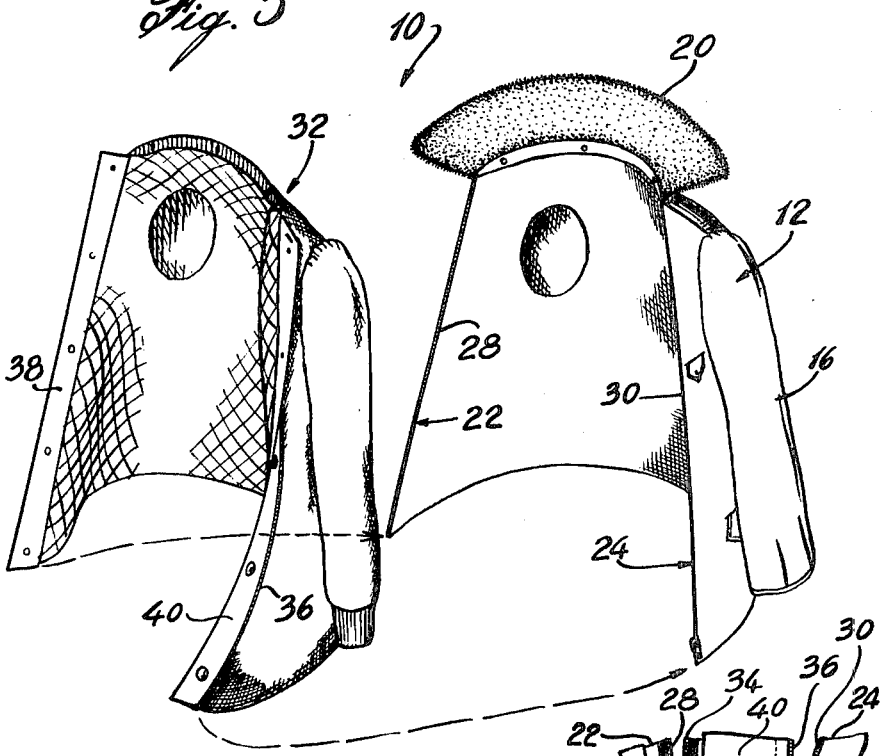
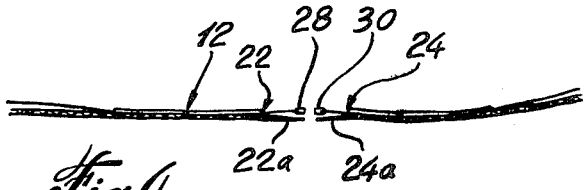
Fig. 4
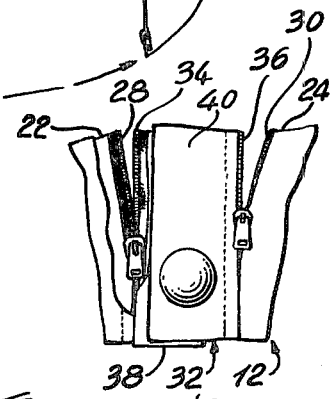
Fig. 6
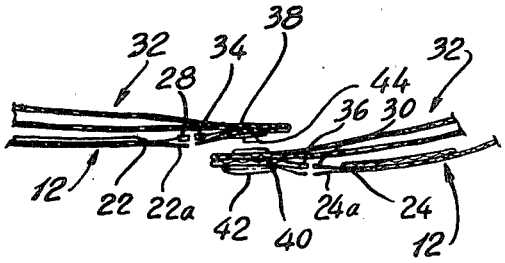
Fig. 5

OUTERWEAR

BACKGROUND OF INVENTION

1. Field of Invention

The present invention relates to garments, such as coats and jackets, and more particularly, to outerwear of the type having an inner liner shell and an outer covering shell.

2. Description of Prior Art

There are many examples of conventional coats or jackets having a removable insulating lining which is fastened within an outer protective cover, whereby the outer shell or cover can be used without the liner in certain conditions. For instance, present day spring and fall coats often have a removable lining which is fastened by a peripheral slide fastener within the outer shell with the zipper being close to the marginal edges of the outer shell. The patents which illustrate different embodiments of such detachable liners in coats include U.S. Pat. Nos. 2,441,122 Sturz (1948); 2,581,206 Rosenfeld (1952); 2,582,772 Egbert (1952); 2,711,539 Loscher (1955); and 3,805,296 Frick (1974). These are examples of various outerwear, such as coats and jackets having detachable liners.

One of the main disadvantages of such outerwear is the problem of girth. For instance, if the outer shell, which is meant to be worn with or without the inner liner, is designed to fit the wearer when the liner is included, then when the coat is being worn without the liner, the girth of the outer shell will appear to be too great and will fit uncomfortably loosely on the wearer. On the other hand, if the outerwear is made such that the outer shell suitably fits the wearer without the liner, then when the liner is provided it will appear to be too tight on the wearer.

SUMMARY OF THE INVENTION

It is an aim of the present invention to provide outerwear, such as a coat or jacket, which includes a removable inner liner and an outer shell wherein the outer shell will be compensated for the proper girth of the wearer when a liner is provided in the outer shell.

A further aim of the present invention is to provide an outer shell of a jacket or coat which, when worn without a liner, will have the proper girth, and when worn with the liner, will be expanded to compensate for the increased bulk of the liner providing the same girth as with the independent outer shell.

Outerwear in accordance with the present invention includes an outer shell and an inner shell, the outer and inner shells each having front edges; the front edges of the outer shell including mating fastener means on the edges thereof, the inner shell including respective mating fastening means spaced from each edge thereof and adapted to mate with the individual fastening means on the edge of the outer shell, the portion of the inner shell between each front edge and each spaced fastening means defining the panels matching in appearance with the outer shell and fastening between the panels; whereby when the outer shell is worn independently, the respective mating fastening means on the front edges of the outer shell are fastened together and provide a predetermined girth, and when the inner shell is worn with the outer shell as a composite garment, the fastening means of the outer shell engage respective mating fastening means on the inner shell and the panels extending from the margins of the inner shell are fastened together such that the appearance of the panels are consistent with the appearance of the outer shell and the girth provided by the inner shell in the panel is the same as the predetermined girth of the outer shell worn independently.

In a more specific construction in accordance with the present invention, there is provided on one front edge of the outer shell a slide fastener stringer and the other edge of the outer shell has a similar slide fastener stringer with one of the stringers including a separable fastening device to cooperate with the other stringer, the liner has a first slide fastener stringer spaced from the edge thereof, forming a panel between the edge and the stringer, and a second slide fastener stringer spaced from the other edge of the liner forming a second panel between the edge and the stringer, each stringer on the liner being adapted to mate with the slide fastener stringer on the respective edges of the outer shell, and fastener means being provided between the panels of the liner.

BRIEF DESCRIPTION OF THE DRAWINGS

Having thus generally described the nature of the invention, reference will now be made to the accompanying drawings showing by way of illustration a preferred embodiment thereof, and in which:

FIG. 3 is a perspective exploded view showing the inner shell separate from the outer shell.

FIG. 4 is a horizontal cross-section taken along lines 4—4 of FIG. 1.

FIG. 5 is a horizontal cross-section taken along lines 5—5 of FIG. 2.

FIG. 6 is a fragmentary enlarged elevational view of a detail thereof.

DESCRIPTION OF PREFERRED EMBODIMENT

Figure 1:
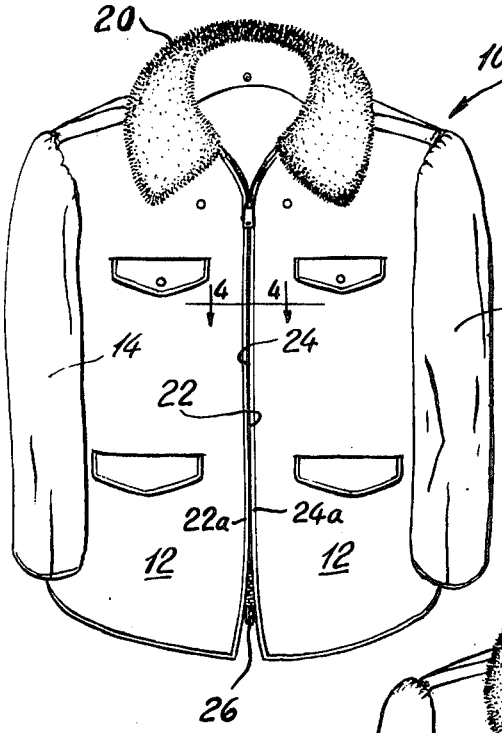
FIG. 1 is a front elevation of a typical outerwear type jacket showing the outer shell without the liner.
Figure 2:
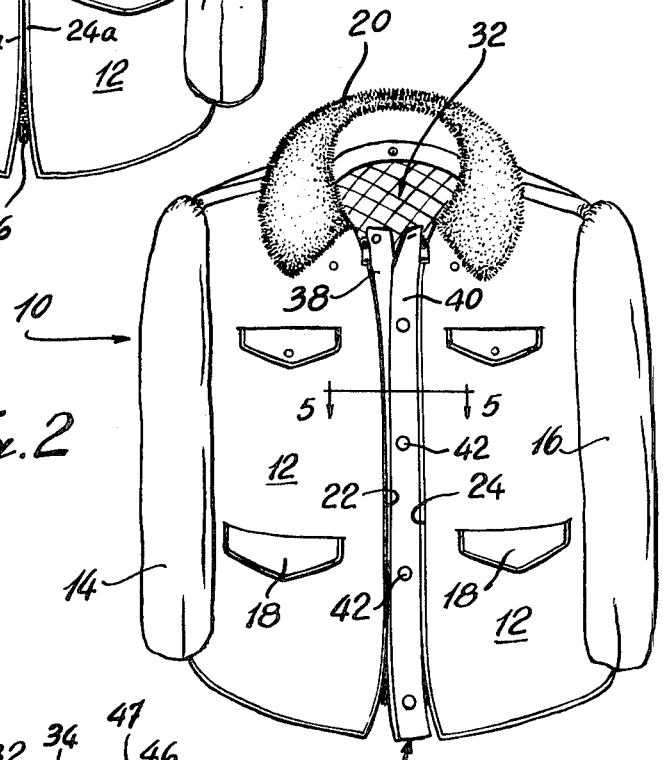
FIG. 2 is a similar front elevation of the jacket shown in FIG. 1 but including the inner shell.

Referring now to the drawings, there is shown in FIGS. 1, 2, and 3 an outerwear jacket 10 including an outer shell 12 fitted with sleeves 14 and 16. The front of the jacket includes pocket flaps 18. The neck opening of the jacket is provided with a collar 20.

The outer shell 12 shown in FIG. 1 includes front edges 22 and 24 to which is mounted a slide fastener 26. The slide fastener is made up of slide fastener stringer 28 sewn to the front edge 22 and slide fastener stringer 30 sewn to the front edge 24 of the outer shell 12. The slide fastener 26 is hidden from the view when the jacket is closed by short flaps **22*a* and 24*a***.

As shown in FIGS. 2 and 3 the liner 32 mounts a slide fastener stringer 34 spaced from a front edge thereof and projecting in the reverse direction. Stringer 34 is adapted to mate with the slide fastener stringer 28 on the front edge 22 of the outer shell. The portion between the stringer 34 and the edge of the fabric represents panel 38 which is made up of material similar to the outer shell 12. In the embodiment shown in FIGS. 2, 3, 5, and 6, the panel 38 is also provided with a series of male snap fasteners 44.

The other front edge of the liner is provided with a panel 40 and a slide fastener stringer 36 disposed in the opposite direction from the edge of the liner 32. The slide fastener stringer 36 is adapted to mate with the slide fastener stringer 30 of the outer shell 12. The panel 40 is also made up with material similar to the outer shell 12 and is adapted to match therewith. The panel 40 includes a series of female snap fasteners adapted to mate with the male snap fasteners 44 of the panel 38.

When it is required to wear the outer shell 12 independently without the liner 32, the liner 32 is removed as shown in FIG. 3 and the slide fastener stringers 28 and 30 are mated together by a slide fastener as shown in FIGS. 1 and 4. The girth of the outer shell 12 is adjusted so as to fit the wearer without the liner.

When the liner is required in case of more intemperate weather, the slide fasteners 28 and 30 of the outer shell are now made to mate with the slide fasteners 34 and 36 of the inner shell 32 respectively. This increases the size of the outerwear jacket 10 by the width of the marginal panels 38 and 40. As the outerwear jacket 10 is composed together as shown in FIG. 2 it may be snap fastened together by means of snap fasteners 42 and 44.

The girth of the overall jacket has been increased by the net width of the overlapping flaps 38 and 40 represented by the double arrowed line in FIG. 5. This increase in the overall girth of the jacket is to compensate for the reduction in the internal girth witnessed by the addition of an internal liner or shell 32. In this case since the overall girth has been increased, the inner girth of the inner shell is the same as the girth of the outer shell when worn independently as shown in FIG. 1.

Figure 7:
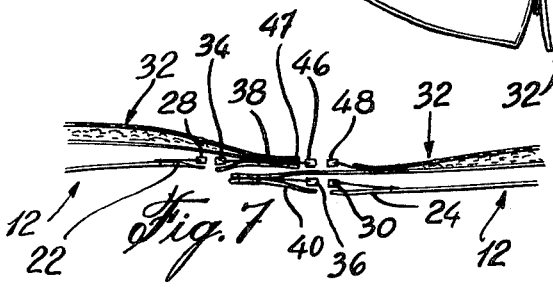
FIG. 7 is a horizontal cross-section similar to FIG. 5 but showing another embodiment thereof.

Another embodiment of the outerwear is illustrated in the cross-section of FIG. 7 wherein instead of using snap fasteners for closing the overlapping panels 38 and 40 which form the closure of the top of the jacket for outerwear 10, there is provided a further slide fastener represented by stringers 46 and 48 along one edge of 47 of the inner shell 42 and the stringer 48 is spaced from the other edge of the inner shell as shown. When slide fasteners 46 and 48 are fastened together the jacket is closed and the appearance is similar to that in FIG. 2. The overlapping flaps 38 and 40 rather than being allowed to flap loosely can be held together by fabric type fasteners such as that known under the trademark "VELCRO".

As mentioned previously, all of the slide fasteners can be hidden from view by means of short overlapping flaps as represented by flaps 22*a* and 24*a*. Similar flaps are built into the panels 38 and 40 and match with the flaps 22*a* and 24*a* when the liner is provided.

I claim:

1. Outerwear including an outer shell and an inner shell, the outer shell and inner shell each having front edges, the inner shell having fastening means spaced from its front edges adapted to engage with similar fastening means on the front edges of the outer shell so as to provide a panel extending beyond the front edges of the outer shell, closure means provided on the panel for effectively closing the assembled outerwear jacket, whereby the inner girth of the outer shell when worn independently of the inner shell is equal to the inner girth of the composite outerwear when the inner shell is provided in the outer shell such that the overall girth of the composite outerwear has been expanded.

2. Outerwear comprising an outer shell and an inner shell, the outer shell and inner shell each having front edges; the front edges of the outer shell including mating fastening means on the edges thereof, the inner shell including respective mating fastening spaced from each edge thereof and adapted to mate with the individual fastening means on the edge of the outer shell, the portion of the inner shell between each front edge and each spaced fastening defining panels, the panels matching in appearance with the outer shell and fastening means between the panels whereby when the outer shell is worn independently the respective mating fastening means on the front edges of the outer shell are fastened together and provide a predetermined girth, and when the inner shell is worn with the outer shell as a composite garment the fastening means of the outer shell engage respective mating fastening means on the inner shell and the panels extending from the margins of the inner shell are fastened together such that the appearance of the panels are consistent with the appearance of the outer shell and the inner girth provided by the inner shell is the same as the predetermined girth as the outer shell worn independently.

3. Outerwear as defined in claim 2, wherein four fastener stringers are provided one on each edge of the front of the outer shell, each stringer adapted to mate together to form a separable slide fastener closure, the inner shell having a first slide fastener stringer spaced from the front edge thereof, forming a panel between the edge and the stringer and a second slide fastener stringer spaced from the other front edge of the inner shell forming a second panel between the edge and the stringer, each stringer on the liner being adapted to mate with the slide fastener stringer on the respective edges on the outer shell and fastener means being provided between the panels of the liner.

4. Outerwear as defined in claim 3, wherein the fastener means provided between the panels on the liner include mating male and female snap fasteners.

5. Outerwear as defined in claim 3, wherein the fastener means provided between the panels includes a slide fastener with one stringer provided on the edge of the front edge of the inner shell and the other stringer provided spaced from the edge of the inner shell on the inside thereof and adapted to mate with the other stringer such that the panels overlap.

6. An outerwear as defined in claim 1, wherein the increased overall width of the overlapping fastened panels of the inner shell compensate for the normal decrease in inner girth of the liner that is provided in the outerwear.

* * * * *